US006428891B1

(12) United States Patent
Okuya et al.

(10) Patent No.: US 6,428,891 B1
(45) Date of Patent: Aug. 6, 2002

(54) ACRYLONITRILE-BASED PRECURSOR FIBER FOR CARBON FIBER AND METHOD FOR PRODUCTION THEREOF

(75) Inventors: Takahiro Okuya; Mitsuo Hamada; Yoshitaka Kageyama; Takeaki Amakawa, all of Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 09/743,811

(22) PCT Filed: Jul. 22, 1999

(86) PCT No.: PCT/JP99/03905

§ 371 (c)(1),
(2), (4) Date: Jan. 22, 2001

(87) PCT Pub. No.: WO00/05440

PCT Pub. Date: Feb. 3, 2000

(30) Foreign Application Priority Data

Jul. 22, 1998 (JP) ..... 10-206673

(51) Int. Cl.[7] ..... D01F 6/00; D01F 9/12; D01D 4/00

(52) U.S. Cl. ..... 428/364; 428/394; 428/367; 264/706

(58) Field of Search ..... 428/364, 394, 428/367; 264/206; 423/447.1

(56) References Cited

U.S. PATENT DOCUMENTS 5,348,802 A * 9/1994 Matsuhisa et al. ..... 428/364
5,413,858 A * 5/1995 Hajikano et al. ..... 428/364

FOREIGN PATENT DOCUMENTS

JP 411081039 * 3/1999

* cited by examiner

*Primary Examiner*—N. Edwards
(74) *Attorney, Agent, or Firm*—Oblon, Spivak, McClelland, Maier & Neustadt, P.C.

(57) ABSTRACT

This invention relates to an acrylonitrile-based precursor fiber for carbon fiber which is prepared from an acrylonitrile-based copolymer containing 96.0 to 98.5% by weight of acrylonitrile units, and which is characterized by a tensile strength of not less than 7.0 cN/dtex, an elastic modulus in tension of not less than 130 cN/dtex, an iodine adsorption of not greater than 0.5% by weight based on the weight of the fiber, a degree of crystal orientation (π) of not less than 90% as determined by wide-angle X-ray analysis, and a degree of variation in tow fineness of not greater than 1.0%. This precursor fiber has a high strength, a high elastic modulus, a high degree of denseness, a high degree of orientation, and a low degree of variation in tow fineness, and can hence be used to form a high-quality carbon fiber inexpensively by oxidation for a shorter period of time.

25 Claims, 1 Drawing Sheet

ACRYLONITRILE-BASED PRECURSOR FIBER FOR CARBON FIBER AND METHOD FOR PRODUCTION THEREOF

TECHNICAL FIELD

This invention relates to polyacrylonitrile-based precursor fibers for carbon fibers and a process for preparing the same.

BACKGROUND ART

Carbon fibers and graphite fibers (herein referred to collectively as "carbon fibers") formed by using polyacrylonitrile-based fibers as precursors have excellent mechanical properties and are hence being commercially produced and sold as fibrous reinforcements of high-performance composite materials for use in aerospace applications, sports and leisure applications, and the like. Moreover, in recent years, the demand for carbon fibers is growing in general industrial applications such as automobile and marine applications and building material applications. Thus, in order to enhance the performance of such composite materials, inexpensive carbon fibers having high quality are desired in the market.

In contrast to acrylic fibers for clothing use, acrylonitrile-based fibers for use as precursors of carbon fibers are no more than intermediate products for the formation of carbon fibers as final products. Accordingly, it is not only desirable to provide acrylonitrile-based fibers capable of yielding carbon fibers having excellent quality and performance, but it is also very important that the acrylonitrile-based fibers have good stability during spinning of precursor fibers, exhibit high productivity in forming carbon fibers, and can be provided at low cost.

From this point of view, a large number of propositions have been made in order to provide acrylonitrile-based fibers capable of yielding carbon fibers having high strength and high elasticity. These propositions include, for example, an increase in the polymerization degree of the copolymer, and a decrease in the content of copolymerized components other than acrylonitrile. As to the spinning method, dry-wet spinning is commonly employed.

However, when the content of copolymerized components other than acrylonitrile is decreased, the solubility of the resulting copolymer in solvents is generally reduced. This not only detracts from the stability of the spinning solution, but also causes an extreme increase in the viscosity of the spinning solution, making it necessary to reduce the copolymer concentration in the spinning solution correspondingly. Consequently, the copolymer shows a marked tendency toward precipitation and coagulation, so that the resulting fibers may frequently undergo devitrification or develop a large number of voids therein. Thus, this production method cannot be regarded as a stable one.

Since the dry-wet spinning process comprises extruding a polymer solution through a nozzle into air and then passing it continuously through a coagulating bath to form filaments, it is easy to obtain dense coagulated filaments. On the other hand, a decrease in the pitch of nozzle holes will cause a problem in that adjacent filaments may adhere to each other. Thus, there is a limit to the number of nozzle holes.

Generally, an increased density of nozzle holes is advantageous for the low-cost production of acrylonitrile-based precursor fibers. Accordingly, the wet spinning process is being employed, partly because it requires a relatively low cost of production equipment. However, the resulting filament tow generally include many broken filaments and much fluff. Thus, the resulting precursor fibers have a low tensile strength and a low elastic modulus, and the fiber structure of the precursor fibers is less dense and has a low degree of orientation. Consequently, the mechanical properties of the carbon fibers obtained by carbonizing them are generally unsatisfactory.

For precursor fibers used to form high-quality carbon fibers, it is very important that they are free of minute defects which will be responsible for breakage after they are converted to carbon fibers. In order to minimize such defects, it is necessary that the precursor fibers have a high tensile strength and a high elastic modulus, their fiber structure be highly dense, the copolymer be highly oriented in the direction of the fiber axis, and the degree of variation in tow size be small.

For example, Japanese Patent Laid-Open No. 214518/'83 makes mention of the denseness of the fiber structure while employing the wet spinning process. As measures of the denseness, the amount of iodine adsorbed and the thickness of the skin layer to which iodine is adsorbed are defined therein. However, the precursor fiber thus obtained has a low density as demonstrated by an iodine adsorption of about 1–3% by weight, and also has a low tensile strength and a low elastic modulus. Consequently, it is very difficult to produce a carbon fiber having high quality.

On the other hand, Japanese Patent Laid-Open No. 35821/'88 discloses a precursor fiber which has been prepared by the dry-wet spinning process and which has a highly densified surface structure. Moreover, Japanese Patent Laid-Open Nos. 21905/'85 and 117814/'87 disclose precursor fibers which have also been prepared by the dry-wet spinning process and which have a high tensile strength and a high elastic modulus and comprise a copolymer highly oriented in the direction of the fiber axis. Although an improvement in the quality of the resulting carbon fibers can be achieved by using these precursor fibers, their productivity is low owing to the use of the dry-wet spinning process. Moreover, the fibers prepared by dry-wet spinning have a smoother surface as compared with the fibers prepared by wet spinning. The former fibers exhibit good bundling properties, but also have several disadvantages in that they tend to fuse together in the oxidation step and in that they tend to show poor spreadability in the formation of a sheet-like prepreg. Furthermore, the polymers used in these inventions practically have an acrylonitrile content of not less than 99.0% by weight. Accordingly, from the viewpoint of the stability of the spinning solution and the tendency of the copolymer toward precipitation and coagulation, these processes are unsatisfactory for the stable preparation of a precursor fiber.

In order to obtain a precursor fiber having a densified surface structure while employing the wet spinning process, pressurized steam drawing has been investigated as a drawing method for achieving a higher draw ratio.

For example, Japanese Patent Laid-Open No. 70812/'95 discloses a precursor fiber which has been prepared by the wet spinning process but has a densified surface structure. In this patent, the densification of a precursor fiber has been achieved by using a copolymer having a specific composition and a coagulated fiber having specific properties, in combination with pressurized steam drawing. However, since no consideration is given to the appropriate range of drawing conditions after coagulation, this process is unsatisfactory for the purpose of preparing a precursor fiber having a high degree of denseness and a high degree of orientation. Moreover, since no mention is made of the strength, elastic modulus, degree of crystal orientation, and degree of variation in tow fineness of the resulting precursor fiber, the properties of a precursor fiber which are required for the formation of a carbon fiber having excellent quality have been still unknown. Furthermore, it has been difficult to spin a precursor fiber stably at a high spinning speed of not less than 100 m per minute.

Thus, all conventional techniques have failed to provide a satisfactory precursor fiber for the formation of a high-quality and inexpensive carbon fiber and a satisfactory process for preparing the same.

DISCLOSURE OF THE INVENTION

The present invention has been made in view of the above-described problems of the prior art, and an object thereof is to provide an acrylonitrile-based precursor fiber for carbon fiber which has a high strength, a high elastic modulus, a high degree of denseness, a high degree of orientation, and a low degree of variation in tow fineness, and can hence be used to form a high-quality carbon fiber inexpensively by carbonizing for a shorter period of time, as well as a wet spinning process by which such an acrylonitrile-based precursor fiber for carbon fiber which has such properties can be rapidly and stably prepared without suffering fiber breakage frequently and without producing any appreciable amount of fluff.

The present invention relates to an acrylonitrile-based precursor fiber for carbon fiber which is prepared from an acrylonitrile-based copolymer containing 96.0 to 98.5% by weight of acrylonitrile units, the acrylonitrile-based precursor fiber having a tensile strength of not less than 7.0 cN/dtex, an elastic modulus in tension of not less than 130 cN/dtex, an iodine adsorption of not greater than 0.5% by weight based on the weight of the fiber, a degree of crystal orientation ($\pi$) of not less than 90% as determined by wide-angle X-ray analysis, and a degree of variation in tow fineness of not greater than 1.0%.

The aforesaid acrylonitrile-based copolymer is preferably composed of 96.0 to 98.5% by weight of acrylonitrile units, 1.0 to 3.5% by weight of acrylamide units, and 0.5 to 1.0% by weight of carboxyl-containing vinyl monomer units.

In one embodiment of the present invention, the wet spinning process is preferably employed as the method for spinning the acrylonitrile-based precursor fiber for a carbon fiber.

The present invention also relates to a process for preparing an acrylonitrile-based precursor fiber for a carbon fiber which comprises the steps of wet-spinning an acrylonitrile-based copolymer to form a coagulated fiber, subjecting the coagulated fiber to primary drawing comprising in-bath drawing or a combination of in-air drawing and in-bath drawing, and subjecting thus obtained fiber to secondary drawing involving pressurized steam drawing, wherein the temperature of the heating roller located immediately before the introduction of the fiber into a pressurized steam drawing device is adjusted to 120–190° C., the degree of variation in steam pressure used in said pressurized steam drawing is controlled so as to be not greater than 0.5%, and the coagulated fiber is drawn in such a way that the proportion of the secondary draw ratio to the overall draw ratio is greater than 0.2.

In one embodiment of the present invention, the overall draw ratio is preferably not less than 13.

The present invention is more specifically described hereinbelow.

The acrylonitrile-based copolymer (which may hereinafter referred to simply as the copolymer) used for the preparation of the acrylonitrile-based precursor fiber for a carbon fiber (hereinafter referred to as the precursor fiber) in accordance with the present invention contains 96.0 to 98.5% by weight of acrylonitrile units as monomer units. If the content of acrylonitrile units in the copolymer is less than 96% by weight, the fiber may undergo heat fusion in the oxidation step, so that the quality and performance of the carbon fiber tend to be detracted from. Moreover, since the heat resistance of the copolymer is reduced, filaments tend to adhere together during spinning of the precursor fiber, i.e., in the step of drying the fiber or the step of drawing the fiber with a heating roller or pressurized steam. On the other hand, if the content of acrylonitrile units in the copolymer is greater than 98.5% by weight, the solubility of the copolymer in solvents is reduced and, therefore, the stability of the spinning solution is detracted from. Moreover, the copolymer tends to make coagulation fast, making it difficult to prepare dense precursor fiber.

Moreover, the copolymer used in the present invention preferably contains 1.0 to 3.5% by weight of acrylamide units as monomer units. When the content of acrylamide units in the copolymer is 1.0% by weight or greater, the structure of the precursor fiber becomes sufficiently dense and, therefore, a carbon fiber having excellent performance is obtained. Moreover, the reactivity in the oxidation step is greatly affected by slight changes in copolymer composition. However, if the content of acrylamide units is 1.0% by weight or greater, a carbon fiber can be stably produced. Furthermore, it is believed that acrylamide has high random copolymerizability with acrylonitrile and, moreover, a heat treatment causes acrylamide to form ring structure in a manner very similar to that of acrylonitrile. In particular, acrylamide is much less susceptible to thermal decomposition in an oxidizing atmosphere, so that it may be contained in larger amounts as compared with carboxyl-containing vinyl monomers which will be described later. However, as the content of acrylamide units in the copolymer is increased, the content of acrylonitrile units in the copolymer is decreased and the heat resistance of the copolymer is reduced as described previously. Accordingly, the content of acrylamide units is suitably not greater than 3.5% by weight.

Furthermore, the copolymer used in the present invention preferably contains 0.5 to 1.0% by weight of carboxyl-containing vinyl monomer units as monomer units. Usable carboxyl-containing vinyl monomers include, for example, acrylic acid, methacrylic acid and itaconic acid. If the content of carboxyl-containing vinyl monomer units is unduly low, the oxidation reaction is so slow that it become difficult to obtain a high-performance carbon fiber by oxidation for a short period of time. In order to carry out a oxidation treatment in a short period of time, the oxidation temperature must unavoidably be raised. Such high temperatures tend to induce runaway reactions and may cause problems from the viewpoint of processability and safety. On the other hand, if the content of carboxyl-containing vinyl monomer units is unduly high, the oxidation reactivity becomes so high that the region adjacent to the surface of the fiber reacts rapidly during oxidation treatment, while the reaction of the central portion is retarded. Thus, the oxidized fiber exhibits a zoning structure in a cross section thereof. With such a structure, however, the central portion of the fiber in which the oxidized structure is underdeveloped cannot be prevented from being decomposed in the succeeding carbonization step at a higher temperature, resulting in a marked reduction in the performance (in particular, elastic modulus in tension) of the carbon fiber. This tendency becomes more pronounced as the oxidation treatment time is reduced.

Furthermore, from the viewpoint of drawing in the spinning of the precursor fiber and the performance of the carbon fiber, the polymerization degree of the copolymer should preferably be such that its limiting viscosity [η] is not less than 0.8. If the polymerization degree is unduly high, the solubility in solvents is reduced. A reduction in copolymer concentration tends to produce voids and cause a reduction in drawing and spinning stability. For these reasons, it is usually preferable that its limiting viscosity [η] be not greater than 3.5.

The precursor fiber of the present invention is formed from such a copolymer according to the wet spinning process, and has a tensile strength of not less than 7.0 cN/dtex, an elastic modulus in tension of not less than 130 cN/dtex, an iodine adsorption of not greater than 0.5% by weight based on the weight of the fiber, a degree of crystal orientation (π) of not less than 90% as determined by wide-angle X-ray analysis, and a degree of variation in tow fineness of-not greater than 1.0%.

If the tensile strength of the precursor fiber is less than 7.0 cN/dtex or the elastic modulus in tension thereof is less than 130 cN/dtex, the carbon fiber obtained from this precursor fiber has insufficient mechanical properties.

If the iodine adsorption of the precursor fiber is greater than 0.5% by weight, the denseness or orientation of the fiber structure is detracted from and the fiber becomes heterogeneous. This creates flaw during the carbonizing step for converting the precursor fiber to a carbon fiber, and hence causes a reduction in the performance of the resulting carbon fiber. As used herein, the term "iodine adsorption" refers to the amount of iodine adsorbed to the fiber and serves as a measure of the degree of denseness of the fiber structure. Small values indicate that the fiber is denser.

If the degree of crystal orientation (π) of the precursor fiber is less than 90%, the precursor fiber shows a reduction in tensile strength and elastic modulus in tension, and the carbon fiber obtained from the precursor fiber has insufficient mechanical properties. On the other hand, in order to achieve a very high degree of crystal orientation (π), a higher draw ratio is required and this makes spinning process unstable. The range in which the precursor fiber can be easily prepared on an industrial basis is usually not greater than 95%.

As used herein, the term "degree of crystal orientation as determined by wide-angle X-ray analysis" is a measure of the degree of orientation of the copolymer molecular chains constituting the fiber in the direction of the fiber axis. From the half width (H) of circumferential intensity distribution of diffraction points on an equatorial line of the fiber as recorded by wide-angle X-ray analysis, the degree of orientation (π) can be calculated according to the following equation:

$$\text{Degree of orientation } (\pi)=((180-H)/180)\times 100.$$

Moreover, if the degree of variation in tow fineness of the precursor fiber is greater than 1.0%, the resulting carbon fiber shows wide variation in tow weight per unit length, but also is likely to cause problems such as an increase of defects responsible for breakage, a reduction in tensile strength, and the creation of gaps between adjoining tows during the formation of a prepreg. As used herein, the term "degree of variation in tow fineness" refers to the degree of variation determined by measuring the fineness of a tow consecutively in the longitudinal direction.

Furthermore, the precursor fiber of the present invention preferably has a surface roughness coefficient in the range of 2.0 to 4.0. When precursor fibers have such a degree of surface roughness, the fusion of the fibers during oxidation treatment is suppressed, so that they exhibit good processability during oxidation. Moreover, when the resulting carbon fibers are made into a composite material such as prepreg, the impregnation of the matrix resin into the void among carbon fibers is improved. Precursor fibers having a surface roughness coefficient within this range can be prepared by the wet spinning process. As used herein, the term "surface roughness coefficient" refers to a value obtained by using a scanning electron microscope to scan a fiber with primary electrons in a direction perpendicular to the fiber axis (i.e., in the direction of a fiber diameter), observing a curve of secondary (reflected) electrons reflected from the fiber surface, and calculating l/d' in which d' is the diametral length of the central part of the fiber corresponding to 60% of the fiber diameter and l is the total length of the secondary electron curve in the range of d' (converted into the length of a straight line).

Now, the process for the preparation of a precursor fiber in accordance with the present invention is described hereinbelow.

In order to prepare the acrylonitrile-based copolymer used in the present invention, there may be employed any of well-known polymerization techniques such as solution polymerization and slurry polymerization. It is preferable to remove unreacted monomers, polymerization catalyst residues and other impurities from the resulting copolymer to the utmost.

In the present invention, the aforesaid copolymer is wet-spun to form a coagulated fiber. Thereafter, this coagulated fiber is subjected to primary drawing comprising in-bath drawing or a combination of in-air drawing and in-bath drawing, and then to secondary drawing comprising pressurized steam drawing.

In the wet spinning step, the aforesaid acrylonitrile-based copolymer is dissolved in a solvent to prepare a spinning solution. The solvent used for this purpose may be suitably selected from among well-known solvents including organic solvents such as dimethylacetamide, dimethyl sulfoxide and dimethylformamide; and aqueous solutions of inorganic compounds such as zinc chloride and sodium thiocyanate.

Spinning is carried out by extruding the aforesaid spinning solution through nozzle holes having a circular cross section into a coagulating bath. An aqueous solution containing the solvent used for the spinning solution is usually used as the coagulating bath.

Prior to drawing, the coagulated fiber thus obtained preferably has an elastic modulus in tension of 1.1 to 2.2 cN/dtex [dtex (decitex) is a value based on the weight of the copolymer in the coagulated fiber]. If the elastic modulus in tension of the coagulated fiber is less than about 1.1 cN/dtex, the fiber tends to be non-uniformly stretched in the initial stages of the spinning process (e.g., in the coagulating bath), resulting in a variation in tow fineness and in the diameter of filaments within the tow. Moreover, since the various steps of the spinning process suffer a marked increase in drawing load and a considerable variation in drawing, it may become difficult to carry out continuous spinning stably.

On the other hand, if the elastic modulus in tension is greater than about 2.2 cN/dtex, filament breakage tends to occur in the coagulating bath, and subsequent steps may suffer a reduction in drawing and stability. Consequently, it may become difficult to produce a highly oriented fiber.

Such a coagulated fiber can be obtained by controlling the copolymer composition, the solvent, the spinning nozzle, and the extrusion rate from the nozzle, and by regulating the concentration of the spinning solution, the concentration and temperature of the coagulating bath, the spinning draft and the like so as to come within appropriate ranges.

Then, the coagulated fiber is subjected to primary drawing. In-bath drawing may be carried out by drawing the coagulated fiber in the coagulating bath or a drawing bath. Alternatively, the coagulated fiber may be partially drawn in air and then drawn in a bath. The in-bath drawing is usually carried out in a hot water at 50–98° C., either in a single bath or in two or more baths. The fiber may be washed before, after or during drawing.

After in-bath drawing and washing, the fiber is treated with a finish oil in the well-known manner, and then densified by drying. This densification by drying needs to be carried out at a temperature higher than the glass transition temperature of the fiber. In practice, however, this temperature may vary as the fiber is either in a moist state or in a dry state. The densification by drying is preferably carried out with a heating roller having a temperature of about 100 to 200° C. For this purpose, one or more heating rollers may be used.

Thus, it is preferable that, after primary drawing, the fiber is treated with a finish oil and dried to a moisture content of not greater than 2% by weight (in particular, not greater than 1% by weight) by a heating roller, and continuously subjected to secondary drawing involving pressurized steam drawing. The reason for this is that the heating efficiency of the fiber in pressurized steam is enhanced to permit drawing in more compact equipment and that the development of phenomena detracting from quality (e.g., the adhesion of filaments) can be minimized to cause a further improvement in the denseness and degree of orientation of the resulting fiber.

Next, the secondary drawing involving pressurized steam drawing is explained. Pressurized steam drawing is a method comprising drawing a fiber in an atmosphere of pressurized steam. This method not only can achieve a high draw ratio and hence permits stable spinning at a higher speed, but also contributes to an improvement in the denseness and degree of orientation of the resulting fiber.

In the present invention, it is important that, in the secondary drawing involving pressurized steam drawing, the temperature of the heating roller located immediately before the pressurized steam drawing machine is adjusted to 120–190° C., and the degree of variation of steam pressure in the pressurized steam drawing is controlled to be not greater than 0.5%. This makes it possible to minimize variations in the draw ratio applied to the fiber and in the ensuing variations in tow fineness. If the temperature of the heating roller is lower than 120° C., the temperature of the acrylonitrile-based precursor fiber for carbon fiber is not sufficiently raised to cause a reduction in drawing.

The secondary draw ratio is determined by the difference between the speeds of the rollers located on the inlet and outlet sides of the pressurized steam drawing machine. In the present invention, the roller located immediately before the pressurized steam drawing machine is usually a heating roller, and this may also serve as the final heating roller for densification by drying. In the present invention, the secondary drawing is two-stage drawing comprising drawing with the heating roller on the basis of the difference between the speeds of the rollers located on the inlet and outlet sides of the pressurized steam drawing machine, and drawing with pressurized steam.

The draw ratio imparted by the heating roller is determined by the temperature of the heating roller and the drawing tension of the fiber in the secondary drawing. Consequently, the draw ratio imparted by the heating roller varies with drawing tension in the secondary drawing. Since the secondary draw ratio in a fixed period of time is always kept constant by the difference between the speeds of the rollers located on the inlet and outlet sides of the pressurized steam drawing machine, the draw ratio imparted by pressurized steam varies with the draw ratio imparted by the heating roller. That is, the distribution between the draw ratio imparted by the heating roller and the draw ratio imparted by pressurized steam varies.

In pressurized steam drawing, the appropriate treating time for achieving excellent drawing performance varies according to the traveling speed of the fiber, steam pressure and the like. As the traveling speed of the fiber become higher, and as steam pressure becomes lower, a longer treating time is required. In the industrial production of precursor fibers, a treating length ranging from several tens of centimeters to several meters is usually required. Moreover, since a section for preventing the leakage of steam is also required, a time lag occurs between drawing with the heating roller and drawing with pressurized steam. In a fixed period of time, the sum of the draw ratio imparted by the heating roller and the draw ratio imparted by pressurized steam remains constant. In actual equipment, however, both types of drawing are not carried out concurrently. Consequently, the draw ratio imparted to the fiber varies with the distribution between drawing with the heating roller and drawing with pressurized steam, and eventually causes variations in tow fineness.

For this reason, in order to suppress variations in the draw ratio imparted to the fiber, it is effective to minimize the time lag between drawing with the heating roller and drawing with pressurized steam. Accordingly, it is effective to make the length of the pressurized steam drawing machine as small as possible. However, in order to heat the fiber sufficiently and secure industrially stable stretchability, the pressurized steam drawing machine needs to have a certain length. Thus, the prior art has not succeeded in avoiding variations in the draw ratio imparted to the fiber. The present inventors made investigation with a view to solving this problem, and have now revealed that, in order to suppress variations in the draw ratio imparted to the fiber and hence variations in the distribution between drawing with the heating roller and drawing with pressurized steam, it is important to suppress the draw ratio imparted by the heating roller and to minimize variations in the drawing tension of the fiber in the secondary drawing.

As described previously, the draw ratio imparted by the heating roller is determined by the temperature of the heating roller and the tension produced in the fiber by the secondary drawing. Accordingly, this can be suppressed by reducing the temperature of the heating roller and raising the pressure of steam used in the pressurized steam drawing. If the temperature of the heating roller is unduly low, the heating efficiency of the fiber in pressurized steam is reduced. Accordingly, the heating roller is adjusted to a suitable temperature in the range of 130 to 190° C. Moreover, in order to allow the suppression of drawing with the heating roller and the features of pressurized steam drawing to be exhibited clearly, the pressure of steam used in the pressurized steam drawing is preferably not less than 200 kPa·g (gauge pressure; hereinafter the same). Preferably, this steam pressure is suitably regulated with consideration for the treating time. However, unduly high pressures may increase the leakage of steam. From an industrial point of view, a steam pressure of not greater than about 600 kPa·g will suffice.

On the other hand, variations in the drawing tension of the fiber in the secondary drawing can be suppressed by keeping the pressure of steam used in the pressurized steam drawing constant. Variations in the pressure of pressurized steam is preferably controlled so as to be not greater than 0.5%. Moreover, it is also preferable to control the properties of pressurized steam so that its temperature is not higher than the saturated steam temperature at the pressure of interest by about 3° C. and no water droplets are contained therein.

By determining the secondary drawing conditions in the above-described manner, it has first becomes possible to suppress variations in the draw ratio imparted to the fiber, to carry out stable spinning at a high draw ratio, and to increase the proportion of the secondary draw ratio to the overall draw ratio. Especially in the case of high-speed spinning which is carried out, for example, at a take-up speed of 100 m per minute and hence requires a high draw ratio, a high-quality precursor fiber can be stably prepared.

Moreover, in a preferred embodiment of the present invention, the proportion of the secondary draw ratio to age the overall draw ratio (secondary draw ratio/overall draw ratio) is greater than 0.2. In a more preferred embodiment, the overall draw ratio is not less than 13. Thus, excellent spinning stability is achieved. As a result, even by employing the wet spinning process, there can be obtained a precursor fiber having excellent tensile properties, a high degree of denseness, and a high degree of orientation.

If the overall draw ratio is less than 13, the fiber cannot be sufficiently oriented and, therefore, the denseness and degree of orientation of the resulting fiber are insufficient. Moreover, if the draft in the coagulating bath is increased in order to compensate for the decrease in draw ratio and thereby enhance productivity, filament breakage tends to occur owing to the high draft in the coagulating bath, and subsequent steps may suffer a reduction in stretchability and stability. If the overall draw ratio is unduly high, stable continuous spinning is difficult owing to increased drawing loads in the primary drawing and the secondary drawing. Under ordinary conditions, the overall draw ratio is preferably not greater than 25.

Moreover, in order to cause the pressurized steam drawing method to fully exhibit its high drawing capabilities and its characteristics in improving the Sued denseness and degree of orientation of the fiber, the proportion of the secondary draw ratio to the overall draw ratio needs to be greater than 0.2. This can reduce drawing loads in the primary drawing, so that no filament breakage occurs and, moreover, no reduction in stretchability or stability is caused in pressurized steam drawing. Consequently, there can be obtained a precursor fiber which is satisfactory with respect to all of denseness, mechanical properties, quality and production stability. These phenomena become more pronounced as the spinning speed is increased. If the proportion of the secondary draw ratio to the overall draw ratio is unduly high, the stability of continuous spinning tends to be reduced owing to an increased load in the secondary drawing. Accordingly, it is usually preferable that the proportion of the secondary draw ratio to the overall draw ratio be not greater than 0.35.

When the carbon fibers obtained by carbonizing acrylonitrile-based precursor fibers for the formation of carbon fibers in accordance with the present invention are arranged in one direction to form a prepreg, they can be made into a prepreg with about 30% higher productivity as compared with conventional carbon fibers. The reason for this is that the acrylonitrile-based precursor fibers for the formation of carbon fibers and hence the carbon fibers have little longitudinal variation in fineness and, therefore, the carbon fibers have little longitudinal variation in openability.

BEST MODE FOR CARRYING OUT THE INVENTION

The present invention is more specifically described with reference to the following examples. In each of the examples and comparative examples, the copolymer composition, the limiting viscosity [η] of the copolymer, the elastic modulus in tension of the coagulated fiber, the tensile strength and elastic modulus of the precursor fiber, the strand strength and elastic modulus of the carbon fiber (abbreviated as CF in the tables), the iodine adsorption, the degree of crystal orientation as measured by wide-angle X-ray analysis, the degree of variation in tow fineness, the surface roughness coefficient, the moisture content of the fiber, and the degree of variation of steam pressure in pressurized steam drawing were determined according to the following methods.

(a) "Copolymer Composition"

This was determined by 1H-NMR spectroscopy (with a Nihon Denshi Model GSZ-400 Superconducting FT-NMR).

(b) "Limiting Viscosity [η] of Copolymer"

This was measured by a dimethylformamide solution at 25° C.

(c) "Elastic Modulus in Tension of Coagulated Fiber"

A bundle of coagulated filaments was collected and quickly subjected to a tension test with a Tensilon in an atmosphere having a temperature of 23° C. and a humidity of 50%. The test conditions included a sample length (grip distance) of 10 cm and a pulling rate of 10 cm per minute.

The fineness. (dtex: the weight of the copolymer per 10,000 m of the coagulated filament bundle) of the coagulated filament bundle was determined according to the following equation, and the elastic modulus was expressed in cN/dtex.

$$dtex=10{,}000\times f\times Qp/V$$

in which f is the number of filaments, Qp is the extrusion rate (g/min.) of the copolymer per nozzle hole, and V is the take-up speed (m/min.) of the coagulated fiber.

(d) "Tensile Strength and Elastic Modulus of Precursor Fiber"

A filament was collected and subjected to a tension test with a Tensilon in an atmosphere having a temperature of 23° C. and a humidity of 50%. The test conditions included a sample length (grip distance) of 2 cm and a pulling rate of 2 cm per minute.

The fineness (dtex: the weight per 10,000 m of the filament) of the filament was determined, and the strength and the elastic modulus were expressed in cN/dtex.

(e) "Strand Strength and Elastic Modulus of Carbon Fiber"

These were measured according to the method described in JIS-7601.

(f) "Method for the Determination of Iodine Adsorption"

Two grams of precursor fibers were accurately weighed out and placed in a 100 ml Erlenmeyer flask. After 100 ml of an iodine solution (prepared by dissolving 100 g of potassium iodide, 90 g of acetic acid, 10 g of 2,4-dichlorophenol, and 50 g of iodine in distilled water enough to make a total volume of 1,000 ml) was added thereto, the flask was shaken at 60° C. for 50 minutes to carry out an iodine adsorption treatment. Thereafter, the fibers having undergone the adsorption treatment were washed with ion-exchanged water for 30 minutes, further washed with distilled water, and then dewatered by centrifugation. The dewatered fibers were placed in a 300 ml beaker. After the addition of 200 ml of dimethyl sulfoxide, the fibers were dissolved therein at 60° C. The amount of iodine adsorbed was determined by subjecting this solution to potentiometric titration using a 0.01 mol/l aqueous solution of silver nitrate.

(g) "Method for the Determination of the Degree of Crystal Orientation as Measured by Wide-angle X-ray Analysis"

This is a value obtained by recording diffraction points on an equatorial line of a polyacrylonitrile-based fiber by wide-angle X-ray analysis, and calculating the degree of orientation ($\pi$) from the half width (H) of the circumferential intensity distribution of the diffraction points according to the following equation.

$$\text{Degree of orientation } (\pi)\ (\%)=((180-H)/180)\times 100$$

Wide-angle X-ray analysis (counter method):

(1) X-ray generator
RU 2000, manufactured by Rigaku Corp.).
X-ray source: CuK$\alpha$ (with a Ni filter).
Output: 40 kV, 190 mA.

(2) Goniometer
2155D1, manufactured by Rigaku Corp.).
Slit system: 2 MM, 0.5°×1°.
Detector: Scintillation counter (h) "Degree of Variation in Tow Fineness"

In the longitudinal direction of a precursor fiber tow, the tow was consecutively cut to obtain 100 segments having a length of accurately 1 m. After these segments were dried in a dryer at 85° C. for 12 hours, the dried weight of each segment was measured. The degree of variation was determined according to the following equation.

$$\text{Degree of variation } (\%)=(\sigma/E)\times 100$$

in which $\sigma$ is the standard deviation of the measured data, and E is the average value of the measured date.

(i) "Method for the Determination of a Surface Roughness Coefficient"

First of all, the contrast conditions of a scanning electron microscope were adjusted by using a magnetic tape as a standard sample. Specifically, using a high-performance magnetic tape as a standard sample, a secondary electron curve was observed under conditions including an acceleration voltage of 13 kV, a magnification of 1,000 diameters, and a scanning speed of 3.6 cm/sec. Thus, the contrast conditions were adjusted so that the average amplitude became equal to about 40 mm. After this adjustment, a sample of a precursor fiber was scanned with primary electrons in a direction perpendicular to the fiber axis (i.e., in the direction of a fiber diameter). Using a line profile apparatus, a curve of secondary (reflected) electrons reflected from the fiber surface was displayed on the screen of a Brown tube and photographed on a film at a magnification of 10,000 diameters. In this step, the acceleration voltage was 13 kV and the scanning speed was 0.18 cm/sec.

The secondary electron photograph thus obtained was further printed while being enlarged twice (i.e., at an overall magnification of 20,000 diameters). Thus, there was obtained a secondary electron curve diagram (photograph). A typical example thereof is shown in FIG. 1. In this figure, d is the fiber diameter, and d' is the diametral length of the region left after a 20% end part has been removed from each side of the fiber diameter (i.e., the diametral length of the central part corresponding to 60% of the fiber diameter) and, therefore, d'=0.6d. l is the total length of the secondary electron curve in the range of d' (converted into the length of a straight line).

From the values of l and d', the surface roughness coefficient can be determined by calculating l/d'.

(j) "Determination of Moisture Content of Fiber"

A fiber was dried in a dryer at 85° C. for 12 hours, and its weight W1 before drying and its weight W2 after drying were measured. Its moisture content was determined according to the following equation.

$$\text{Moisture content } (\%)=((W1-W2)/W2)\times 100$$

(k) "Degree of Variation of Steam Pressure in Pressurized Steam Drawing"

During pressurized steam drawing, the pressure within the drawing machine was monitored for 40 seconds. Pressure data were collected at intervals of 0.04 second, and the degree of variation was determined according to the following equation.

$$\text{Degree of variation } (\%)=(\sigma/E)\times 100$$

in which $\sigma$ is the standard deviation of the measured data, and E is the average value of the measured date.

EXAMPLE 1

A copolymer composed of 97.1% by weight of acrylonitrile, 2.0% by weight of acrylamide, and 0.9% by weight of methacrylic acid and having a limiting viscosity [$\eta$] of 1.7 was dissolved in dimethylformamide to prepare a spinning solution having a copolymer concentration of 23% by weight. Using a nozzle having 12,000 holes, this spinning solution was wet-spun by extruding it into an aqueous solution of dimethylformamide having a concentration of 70% by weight and a temperature of 35° C. The resulting coagulated fiber had an elastic modulus in tension of 1.59 cN/dtex.

After the coagulated fiber was washed and desolvated in hot water while being drawn at a draw ratio of 4.75, the fiber was dipped into a bath of a finish containing silicone, and dried, collapsed by a heating roller at 140° C. The resulting fiber had a moisture content of not greater than 0.1% by weight. Subsequently, the fiber was drawn in pressurized steam having a pressure of 294 kPa·g at a draw ratio of 2.8, and then dried again to obtain a precursor fiber. This precursor fiber was wound up at a speed of 100 m/min. During the pressurized steam drawing, the temperature of the heating roller located immediately before the pressurized steam drawing machine was adjusted to 140° C., and the degree of variation of steam pressure in the pressurized steam drawing was controlled so as to be not greater than 0.2%. The steam supplied to the pressurized steam drawing chamber was freed of water droplets by means of a drain trap, and the temperature of the pressurized steam drawing chamber was adjusted to 142° C.

The overall draw ratio was 13.3, and the proportion of the secondary draw ratio to the overall draw ratio was 0.21.

The control of steam pressure in the pressurized steam drawing was carried out by installing JPG940A and BSTJ300 pressure transmitters (manufactured by Yamatake-Honeywell Corp.) in the drawing machine, sending the resulting data to a PID digital indicating controller (manufactured by Yokogawa Electric Corp.), and changing the opening of an automatic pressure control valve according to instructions from the indicating controller.

In the spinning step, the breakage of filaments and the production of fluff were seldom observed, indicating good spinning stability. This precursor fiber had a tensile strength of 7.5 cN/dtex, an elastic modulus in tension of 147 cN/dtex, an iodine adsorption of 0.2% by weight, a degree of orientation ($\pi$) of 93% by determined by wide-angle X-ray analysis, a degree of variation in tow fineness of 0.6%, and a surface roughness coefficient of 3.0.

Using a hot-air circulation oxidation oven, this fiber was heat-treated in air at 230–260° C. under a 5% stretch for 30 minutes to form a oxidation fiber having a density of 1.368 g/cm$^3$. Subsequently, this fiber was subjected to a low-temperature heat treatment in an atmosphere of nitrogen at a maximum temperature of 600° C. under a 5% stretch for 1.5 minutes. Then, using a high-temperature heat treatment oven having a maximum temperature of 1,400° C., it was further treated in the same atmosphere under a −4% stretch for about 1.5 minutes. The resulting carbon fiber had a strand strength of 4,800 MPa and a strand elastic modulus of 284 GPa.

Comparative Examples 1–3

Spinning was carried out in the same manner as in Example 1, except that the coagulating bath comprised an aqueous solution of dimethylformamide having a concentration of 60% by weight and a temperature of 35° C. (Comparative Example 1), an aqueous solution of dimethylformamide having a concentration of 73% by weight and a temperature of 35° C. (Comparative Example 2), or an aqueous solution of dimethylformamide having a concentration of 70% by weight and a temperature of 50° C. (Comparative Example 3).

In Comparative Example 1 much fluff was produced, and it was difficult to form a precursor fiber continuously. In Comparative Examples 2 and 3, the resulting precursor fiber was carbonized under the same conditions as in Example 1. The elastic modulus in tension of the coagulated fiber, the amount of fluff, tensile strength, elastic modulus, iodine adsorption, and wide-angle X-ray degree of orientation of the precursor fiber, and the strand characteristics of the carbon fiber are shown in Table 1.

Comparative Examples 4 and 5

Spinning was carried out in the same manner as in Example 1, except that the conditions of pressurized steam drawing were altered. Specifically, the temperature of the heating roller located immediately before the pressurized steam drawing machine was 195° C., and the degree of variation of steam pressure in the pressurized steam drawing was about 0.7% (Comparative Example 4), or the temperature of the heating roller located immediately before the pressurized steam drawing machine was 140° C., and the degree of variation of steam pressure in the pressurized steam drawing was about 0.7% (Comparative Example 5).

In Comparative Example 4, the degree of variation in tow fineness of the precursor fiber was 1.7%, while in Comparative Example 5, the degree of variation in tow fineness of the precursor fiber was 1.2%.

EXAMPLES 2–4

The same acrylonitrile-based copolymer as used in Example 1 was dissolved in dimethylacetamide to prepare a spinning solution having a copolymer concentration of 21% by weight. Using a nozzle having 12,000 holes, this spinning solution was wet-spun by extruding it into an aqueous solution of dimethylacetamide having a concentration of 70% by weight and a temperature of 35° C.

Subsequently,. the resulting fiber was drawn in air at a draw ratio of 1.5, and then washed and desolvated in hot water while being drawn. Thereafter, the fiber was dipped into a bath of a finish containing silicone, and dried, collapsed by heating roller at 140° C. Subsequently, the fiber was drawn in pressurized steam having a pressure of 294 kPa·g, and then dried again to obtain a precursor fiber. This precursor fiber was wound up at a speed of 100 m/min. During the pressurized steam drawing, the temperature of the heating roller located immediately before the pressurized steam drawing machine was adjusted to 140° C., and the degree of variation of steam pressure in the pressurized steam drawing was controlled so as to be not greater than 0.2%. The steam supplied to the pressurized steam drawing chamber was freed of water droplets by means of a drain trap, and the temperature of the pressurized steam drawing chamber was adjusted to 142° C.

Furthermore, this fiber was carbonized under the same conditions as in Example 1 to obtain a carbon fiber. With respect to each example, the overall draw ratio and the proportion of the secondary draw ratio to the overall draw ratio, the elastic modulus in tension of the coagulated fiber, the amount of fluff, tensile strength, elastic modulus, iodine adsorption, wide-angle X-ray degree of orientation, and degree of variation in tow fineness of the precursor fiber, and the strand characteristics of the carbon fiber are shown in Table 1.

Comparative Example 6

A precursor fiber was prepared under the same conditions as in Example 2, except that the proportion of the secondary draw ratio to the overall draw ratio was altered to the value shown in Table 1. Furthermore, this fiber was fired under the same conditions as in Example 2 to obtain a carbon fiber. The elastic modulus in tension of the coagulated fiber, the amount of fluff, tensile strength, elastic modulus, iodine adsorption, and wide-angle X-ray degree of orientation of the precursor fiber, and the strand characteristics of the carbon fiber are shown in Table 1.

Comparative Examples 7–11

Precursor fibers were prepared and carbonized under the same conditions as in Example 2, except that the composition of the acrylonitrile-based copolymer was altered as shown in Table 2. With respect to each example, the elastic modulus in tension of the coagulated fiber, the amount of fluff, tensile strength, elastic modulus, iodine adsorption, and wide-angle X-ray degree of orientation of the precursor fiber, and the strand characteristics of the carbon fiber are shown in Table 2. In the case of comparative Example 7, the precursor fiber burned and fumed in the oxidation step.

EXAMPLE 5

The same acrylonitrile-based copolymer as used in Example 1 was dissolved in dimethylacetamide to prepare a spinning solution having a copolymer concentration of 21% by weight. Using a nozzle having 12,000 holes, this spinning solution was wet-spun by extruding it into an aqueous solution of dimethylacetamide having a concentration of 70% by weight and a temperature of 35° C.

Subsequently, the resulting fiber was drawn in air at a draw ratio of 1.5, and then washed and desolvated in hot water while being drawn. Thereafter, the fiber was dipped into a bath of a finish containing silicone, and dried, collapsed by heating roller at 160° C. Subsequently, the fiber was drawn in pressurized steam having a pressure of 294 kPa·g, and then dried again to obtain a precursor fiber. This precursor fiber was wound up at a speed of 140 m/min. During the pressurized steam drawing, the temperature of the heating roller located before the pressurized steam drawing machine was adjusted to 140° C., and the degree of variation of steam pressure in the pressurized steam drawing was controlled so as to be not greater than 0.2%. The steam supplied to the pressurized steam drawing chamber was freed of water droplets by means of a drain trap, and the temperature of the pressurized steam drawing chamber was adjusted to 142° C.

Furthermore, this fiber was carbonized under the same conditions as in Example 1 to obtain a carbon fiber. The overall draw ratio and the proportion of the secondary draw ratio to the overall draw ratio, the elastic modulus in tension of the coagulated fiber, the amount of fluff, tensile strength, elastic modulus, iodine adsorption, wide-angle X-ray degree of orientation, and degree of variation in tow fineness of the precursor fiber, and the strand characteristics of the carbon fiber are shown in Table 2.

EXAMPLE 6

Carbon fibers obtained in Comparative Example 4 were arranged in parallel so as to form a sheet having a carbon fiber basis weight of 125 g/m$^2$. Two resin films (with a resin basis weight of 27 g/m$^2$) were prepared by applying #340 Epoxy Resin (manufactured by Mitsubishi Rayon Co., Ltd.) to mold-releasing paper, and the above sheet was sandwiched therebetween so that the epoxy resin came into contact with the carbon fibers. This assembly was passed through a prepreg production machine to produce a prepreg having a basis weight of 125 g/m$^2$. As the production speed was gradually increased, the openability of carbon fibers was reduced and about 1 mm wide splits including no carbon fiber came to appear at a frequency of 2–3 splits per 4–5 meters. The prepreg production machine used in this example consisted of 7 pairs of heated flat metallic press rolls, 1 pair of cooling rolls, and 1 pair of rubber take-up rolls. When the carbon fibers sandwiched between the resin films prepared by applying an epoxy resin to mold-releasing paper was fed thereto, the resin was fluidized by heating on the surfaces of the press rolls, and pressed so as to cause the resin to penetrate into the carbon fiber layer. Thereafter, the resulting prepreg was cooled and taken up by means of a pair of rubber rolls.

Then, the carbon fibers were replaced by carbon fibers obtained in Example 1. A prepreg having no split could be stably produced even at a production speed 30% higher than the production speed at which splits appeared with the carbon fibers of Comparative Example 4.

Comparative Example 12

An acrylonitrile-based precursor fiber for carbon fiber was prepared in the same manner as in Example 1, except that the temperature of the roller located before the pressurized steam drawing machine was adjusted to 115° C. This fiber produced much fluff and could not be easily wound up.

TABLE 1

| | Copolymer composition, AN/AAM/MAA (wt. %) | Elastic modulus in tension of coagulated fiber (cN/dtex) | Overall draw ratio | Secondary draw ratio/over all draw ratio | Roller temperature before pressurized steam drawing machine (° C.) | Degree of variation of steam pressure in pressurized steam drawing (%) | Precursor fiber: Amount of fluff | Precursor fiber: Tensile strength (cN/dtex) | Precursor fiber: Elastic modulus in tension (cN/dtex)) |
|---|---|---|---|---|---|---|---|---|---|
| Example | | | | | | | | | |
| 1 | 97.1/2.0/0.9 | 1.59 | 13.3 | 0.21 | 140 | ≦0.2 | Little | 7.5 | 147 |
| 2 | " | 1.94 | 13.3 | 0.26 | 140 | ≦0.2 | Little | 7.5 | 159 |
| 3 | " | 1.59 | 16.8 | 0.21 | 140 | ≦0.2 | Little | 8.0 | 159 |
| 4 | " | 1.59 | 16.8 | 0.26 | 140 | ≦0.2 | Little | 8.5 | 168 |
| Comparative Example | | | | | | | | | |
| 1 | 97.1/2.0/0.9 | 3.88 | 13.3 | 0.21 | 140 | ≦0.2 | Much | — | — |
| 2 | " | 1.06 | 13.3 | 0.21 | 140 | ≦0.2 | Moderately much | 6.4 | 132 |
| 3 | " | 3.44 | 13.3 | 0.21 | 140 | ≦0.2 | Moderately much | 5.7 | 124 |
| 4 | " | 1.59 | 13.3 | 0.21 | 195 | about 0.7 | — | — | — |
| 5 | " | 1.59 | 13.3 | 0.21 | 140 | about 0.7 | — | — | — |
| 6 | " | 1.94 | 13.3 | 0.17 | 140 | ≦0.2 | Moderately much | 6.6 | 128 |

| | Precursor fiber: Iodine adsorption (wt. %) | Precursor fiber: Wide-angle X-ray degree of orientation (π) (%) | Precursor fiber: Degree of variation in tow fineness (%) | Time for flameproofing treatment (min.) | CF stand performance: Strength (MPa) | CF stand performance: Elastic modulus (GPa) |
|---|---|---|---|---|---|---|
| Example | | | | | | |
| 1 | 0.2 | 93.0 | 0.6 | 30 | 4800 | 284 |
| 2 | 0.2 | 93.5 | 0.6 | 30 | 4850 | 288 |
| 3 | 0.2 | 93.0 | 0.5 | 30 | 4750 | 286 |
| 4 | 0.15 | 94.0 | 0.6 | 30 | 5000 | 294 |

TABLE 1-continued

| Comparative Example | | | | | | |
|---|---|---|---|---|---|---|
| 1 | — | — | — | — | — | — |
| 2 | 0.5 | 89.0 | — | 30 | 4120 | 245 |
| 3 | 1.2 | 88.0 | — | 30 | 4170 | 245 |
| 4 | — | — | 1.7 | — | — | — |
| 5 | — | — | 1.2 | — | — | — |
| 6 | 0.7 | 89.0 | — | 30 | 4120 | 268 |

(Notes)
AN: Acrylonitrile;
AAM: Acrylamide;
MAA: Methacrylic acid

TABLE 2

| | Copolymer composition, AN/AAM/MAA (wt. %) *1) | Elastic modulus in tension of coagulated fiber (cN/dtex) | Overall draw ratio | Secondary draw ratio/over all draw ratio | Roller temperature before pressurized steam drawing machine (° C.) | Degree of variation of steam pressure in pressurized steam drawing (%) | Precursor fiber | | |
|---|---|---|---|---|---|---|---|---|---|
| | | | | | | | Amount of fluff | Tensile strength (cN/dtex) | Elastic modulus in tension (cN/dtex) |
| Comparative Example | | | | | | | | | |
| 7 | 99.0/0.5/0.5 | 3.18 | 13.3 | 0.26 | 140 | ≦0.2 | Much | 7.1 | 150 |
| 8 | 94.0/5.0/1.0 | 1.32 | 13.3 | 0.26 | 140 | ≦0.2 | Little | 6.4 | 135 |
| 9 | 97.0/1.0/2.0 | 2.21 | 13.3 | 0.26 | 140 | ≦0.2 | Little | 6.5 | 142 |
| 10 | AN/2-HEMA/MAA 97.0/2.0/1.0 | 2.29 | 13.3 | 0.26 | 140 | ≦0.2 | Little | 6.7 | 156 |
| 11 | AN/DAAM/MAA 97.0/2.0/1.0 | 2.03 | 13.3 | 0.26 | 140 | ≦0.2 | Little | 6.6 | 135 |
| Example | | | | | | | | | |
| 5 | AN/AAm/MAA 97.1/2.0/0.9 | 1.41 | 16.3 | 0.21 | 140 | ≦0.2 | Little | 7.9 | 141 |

| | Precursor fiber | | | | CF stand performance | |
|---|---|---|---|---|---|---|
| | Iodine adsorption (wt. %) | Wide-angle X-ray degree of orientation (π) (%) | Degree of variation in tow fineness (%) | Time for flameproofing treatment (min.) | Strength (MPa) | Elastic modulus (GPa) |
| Comparative Example | | | | | | |
| 7 | 0.3 | 92.0 | — | 30 | 4210 | 255 |
| 8 | 1.4 | 90.0 | — | 30 | 4120 | 238 |
| 9 | 0.6 | 91.0 | — | 30 | 4360 | 235 |
| 10 | 0.5 | 91.0 | — | 30 | 4310 | 247 |
| 11 | 0.8 | 90.5 | — | 30 | 4040 | 238 |
| Example | | | | | | |
| 5 | 0.3 | 93.0 | 0.7 | 30 | 4610 | 289 |

(Notes)
*1) AN/AAM/MAA is the composition the case where no constituent monomer units are indicated
AN: Acrylonitrile;
AAM: Acrylamide;
MAA: Methacrylic acid;
2-HEMA: 2-Hydroxyethyl acrylate;
DAAM: Diacetone acrylamide

EXPLOITABILITY IN INDUSTRY

According to the present invention, there is provided an acrylonitrile-based precursor fiber for carbon fiber which has a high strength, a high elastic modulus, a high degree of denseness, a high degree of orientation, and a low degree of variation in tow fineness, and can hence be used to form a high-quality carbon fiber inexpensively by carbonizing for a shorter period of time.

Moreover, according to the wet spinning process, an acrylonitrile-based precursor fiber for carbon fiber which has such properties can be rapidly and stably prepared without suffering fiber breakage frequently and without producing any appreciable amount of fluff.

The acrylonitrile-based precursor fiber for carbon fiber in accordance with the present invention has substantial uniformity of fineness in the longitudinal direction, and the carbon fiber obtained by carbonizing it has also substantial uniformity of fineness in the longitudinal direction. This causes less variation of openability in the longitudinal direction, so that this carbon fiber can be formed into prepregs with about 30% higher productivity as compared with conventional carbon fibers.

Figure 1:
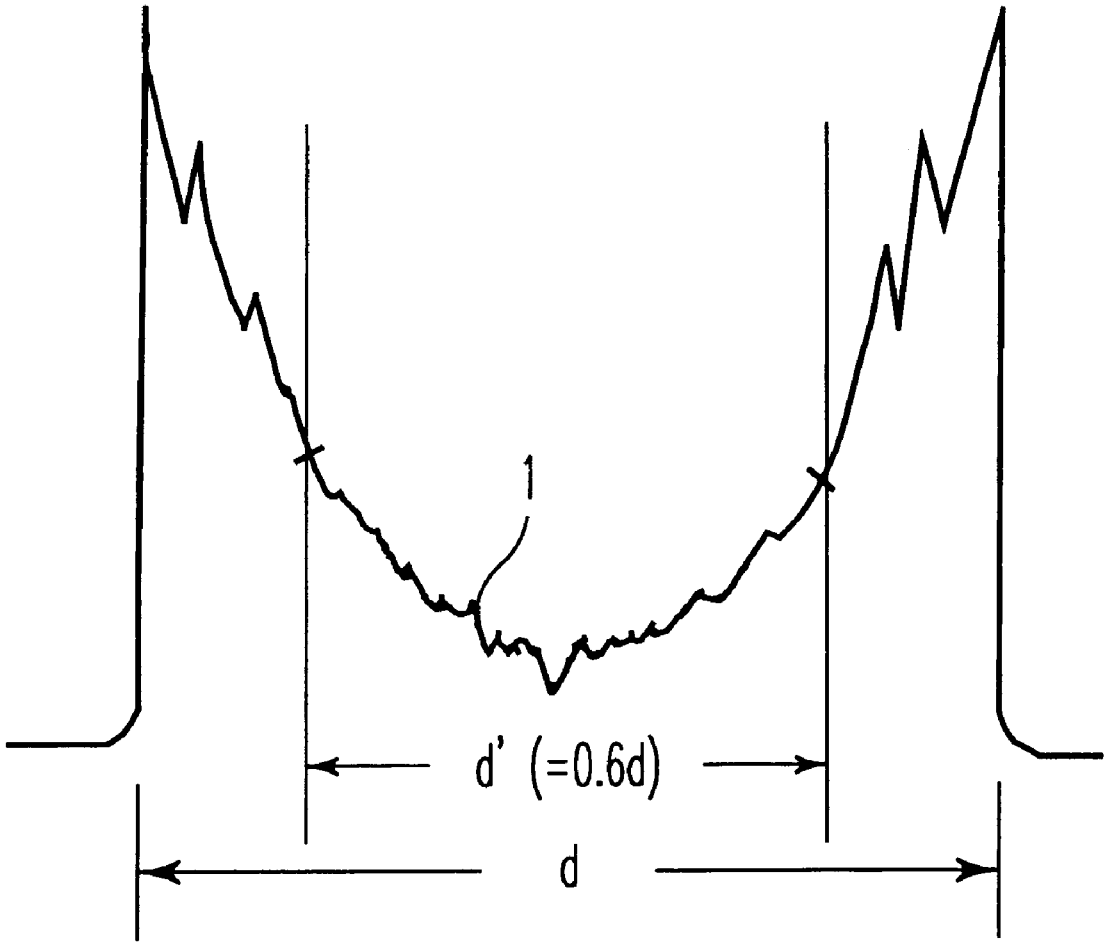
FIG. 1 is a secondary electron curve diagram for the determination of a surface roughness coefficient.

DEFINITIONS OF CHARACTERS d The fiber diameter.

d' The diametral length of a central part of the fiber which corresponds to 60% of the fiber diameter.

The total length of the secondary electron curve in the range of d' (converted into the length of a straight line).

What is claimed is:

1. An acrylonitrile-based precursor fiber of an acrylonitrile-based copolymer containing 96.0 to 98.5% by weight of acrylonitrile units, said acrylonitrile-based precursor fiber having a tensile strength of not less than 7.0 cN/dtex, an elastic modulus in tension of not less than 130 cN/dtex, an iodine adsorption of not greater than 0.5% by weight based on the weight of the fiber, a degree of crystal orientation ($\pi$) of not less than 90% as determined by wide-angle X-ray analysis, and, when made into a tow, a degree of variation in tow fineness of not greater than 1.0%.

2. An acrylonitrile-based precursor fiber as claimed in claim 1 wherein said acrylonitrile-based copolymer is composed of 96.0 to 98.5% by weight of acrylonitrile units, 1.0 to 3.5% by weight of acrylamide units, and 0.5 to 1.0% by weight of carboxyl-containing vinyl monomer units.

3. An acrylonitrile-based precursor fiber as claimed in claim 1 which has been formed by the wet spinning process.

4. A process for preparing an acrylonitrile-based precursor fiber as claimed in claim 1, which comprises the steps of wet-spinning an acrylonitrile-based copolymer to form a coagulated fiber, subjecting the coagulated fiber to primary drawing comprising in-bath drawing or a combination of in-air drawing and in-bath drawing, and subjecting thus obtained fiber to secondary drawing involving pressurized steam drawing, wherein the temperature of the heating roller located immediately before the introduction of the fiber into a pressurized steam drawing machine is adjusted to 120–190° C., the degree of variation of steam pressure in said pressurized steam drawing is controlled so as to be not greater than 0.5%, and the coagulated fiber is drawn in such a way that the proportion of the secondary draw ratio to the overall draw ratio is greater than 0.2.

5. A process for preparing an acrylonitrile-based precursor fiber for carbon fiber as claimed in claim 4 wherein the overall draw ratio is not less than 13.

6. A process for preparing an acrylonitrile-based precursor fiber for carbon fiber as claimed in claim 4 wherein said acrylonitrile-based copolymer is composed of 96.0 to 98.5% by weight of acrylonitrile units, 1.0 to 3.5% by weight of acrylamide units, and 0.5 to 1.0% by weight of carboxyl-containing vinyl monomer units.

7. A process for preparing an acrylonitrile-based precursor fiber for carbon fiber as claimed in claim 4, wherein, prior to drawing, the coagulated fiber has an elastic modulus in tension of 1.1 to 2.2 cN/dtex.

8. A process for preparing an acrylonitrile-based precursor fiber for carbon fiber as claimed in claim 4 wherein said pressurized steam drawing is carried out at a steam pressure of not less than 200 kPa (gauge pressure).

9. A process for preparing an acrylonitrile-based precursor fiber for carbon fiber as claimed in claim 4 wherein the fiber subjected to said pressurized steam drawing has a moisture content of not greater than 2% by weight.

10. A carbon fiber formed by oxidation and carbonizing an acrylonitrile-based precursor fiber for carbon fiber as claimed in claim 1.

11. An acrylonitrile-based precursor fiber for carbon fiber as claimed in claim 2 which has been formed by the wet spinning process.

12. A process for preparing an acrylonitrile-based precursor fiber for carbon fiber as claimed in claim 5 wherein said acrylonitrile-based copolymer is composed of 96.0 to 98.5% by weight of acrylonitrile units, 1.0 to 3.5% by weight of acrylamide units, and 0.5 to 1.0% by weight of carboxyl-containing vinyl monomer units.

13. The process for preparing an acrylonitrile-based precursor fiber for carbon fiber as claimed in claim 12 wherein, prior to drawing, the coagulated fiber has an elastic modulus in tension of 1.1 to 2.2 cN/dtex.

14. The process for preparing an acrylonitrile-based precursor fiber for carbon fiber as claimed in claim 13 wherein said pressurized steam drawing is carried out at a steam pressure of not less than 200 kPa (gauge pressure).

15. The process for preparing an acrylonitrile-based precursor fiber for carbon fiber as claimed in claim 14 wherein the fiber subjected to said pressurized steam drawing has a moisture content of not greater than 2% by weight.

16. A carbon fiber formed by oxidation and carbonizing an acrylonitrile-based precursor fiber for carbon fiber as claimed in claim 2.

17. A carbon fiber formed by oxidation and carbonizing an acrylonitrile-based precursor fiber for carbon fiber as claimed in claim 3.

18. A tow consisting of acrylonitrile-based precursor fibers prepared from an acrylonitrile-based copolymer containing 96.0 to 98.5% by weight of acrylonitrile units, said acrylonitrile-based precursor fiber having a tensile strength of not less than 7.0 cN/dtex, an elastic modulus in tension of not less than 130 cN/dtex, an iodine adsorption of not greater than 0.5% by weight based on the weight of the fiber, a degree of crystal orientation ($\pi$) of not less than 90% as determined by wide-angle X-ray analysis, and a degree of variation in tow fineness of not greater than 1.0%.

19. A tow as claimed in claim 18 wherein said acrylonitrile-based copolymer is composed of 96.0 to 98.5% by weight of acrylonitrile units, 1.0 to 3.5% by weight of acrylamide units, and 0.5 to 1.0% by weight of carboxyl-containing vinyl monomer units.

20. A tow as claimed in claim 18 which has been formed by a wet spinning process.

21. A tow as claimed in claim 19 which has been formed by a wet spinning process.

22. An acrylonitrile-based precursor fiber of an acrylonitrile-based copolymer containing 96.0 to 98.5% by weight of acrylonitrile units, said acrylonitrile-based precursor fiber having a tensile strength of not less than 7.0 cN/dtex, an elastic modulus in tension of not less than 130 cN/dtex, an iodine adsorption of not greater than 0.5% by weight based on the weight of the fiber, a degree of crystal orientation ($\pi$) of not less than 90% as determined by wide-angle X-ray analysis.

23. An acrylonitrile-based precursor fiber as claimed in claim 22 wherein said acrylonitrile-based copolymer is composed of 96.0 to 98.5% by weight of acrylonitrile units, 1.0 to 3.5% by weight of acrylamide units, and 0.5 to 1.0% by weight of carboxyl-containing vinyl monomer units.

24. An acrylonitrile-based precursor fiber as claimed in claim 22 which has been formed by a wet spinning process.

25. An acrylonitrile-based precursor fiber as claimed in claim 23 which has been formed by a wet spinning process.

* * * * *